US007377620B2

(12) United States Patent
Wu et al.

(10) Patent No.: US 7,377,620 B2
(45) Date of Patent: May 27, 2008

(54) HYDROPHOBIC NOZZLE EXIT WITH IMPROVED MICRO FLUID EJECTION DYNAMICS

(75) Inventors: Carl Lan Wu, Corvallis, OR (US); Erik D. Torniainen, Albany, OR (US); Mark Sanders Taylor, Monmouth, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 339 days.

(21) Appl. No.: 11/138,775

(22) Filed: May 26, 2005

(65) Prior Publication Data

US 2006/0268059 A1 Nov. 30, 2006

(51) Int. Cl.
*B41J 2/135* (2006.01)

(52) U.S. Cl. ..... 347/45; 347/14

(58) Field of Classification Search ..... 347/14, 347/19, 20, 44–45, 47, 56; 29/890.1, 890.142, 29/611

See application file for complete search history.

(56) References Cited

U.S. PATENT DOCUMENTS

| | | | | |
|---|---|---|---|---|
| 5,387,440 | A | 2/1995 | Takemoto et al. | 347/45 |
| 5,461,406 | A | 10/1995 | Lorenze et al. | 347/65 |
| 5,557,307 | A | 9/1996 | Paroff | 347/34 |
| 5,574,485 | A | 11/1996 | Anderson et al. | 347/27 |
| 5,595,785 | A | 1/1997 | Hindagolla et al. | 347/45 |
| 5,633,664 | A | 5/1997 | Bayat | 347/47 |
| 5,790,146 | A | 8/1998 | Anderson | 347/28 |
| 5,802,687 | A | 9/1998 | Thiel et al. | 29/890.1 |
| 5,877,788 | A | 3/1999 | Haan et al. | 347/28 |
| 6,102,521 | A | 8/2000 | Halko et al. | 347/47 |
| 6,126,269 | A * | 10/2000 | Takemoto et al. | 347/45 |
| 6,257,700 | B1 | 7/2001 | Aihara et al. | 347/44 |
| 6,276,057 | B1 | 8/2001 | Aihara et al. | 29/890.1 |
| 6,286,933 | B1 | 9/2001 | Murakami et al. | 347/45 |
| 6,325,490 | B1 | 12/2001 | Yang et al. | 347/45 |
| 6,402,300 | B1 | 6/2002 | Silverbrook | 347/54 |
| 6,488,357 | B2 | 12/2002 | Skinner et al. | 347/47 |
| 6,491,370 | B2 | 12/2002 | Momose | 347/30 |
| 6,511,155 | B1 | 1/2003 | Fassler et al. | 347/35 |
| 6,619,783 | B2 | 9/2003 | Kanaya et al. | 347/35 |
| 6,676,244 | B2 | 1/2004 | Kwon et al. | 347/45 |
| 6,737,109 | B2 | 5/2004 | Stanton et al. | 347/45 |
| 6,966,630 | B2 * | 11/2005 | Sasaki et al. | 347/45 |
| 2002/0033863 | A1 | 3/2002 | Silverbrook | 347/54 |
| 2002/0051037 | A1 | 5/2002 | Silverbrook | 347/54 |
| 2003/0025758 | A1 | 2/2003 | Silverbrook | 347/42 |
| 2003/0025761 | A1 | 2/2003 | Silverbrook | 347/47 |
| 2003/0085973 | A1 | 5/2003 | Yokouchi | 347/101 |
| 2003/0121531 | A1 | 7/2003 | Fassler et al. | 134/6 |

FOREIGN PATENT DOCUMENTS

| | | |
|---|---|---|
| JP | 05293963 | 11/1993 |
| JP | 05345419 | 12/1993 |
| JP | 06340071 | 12/1994 |
| JP | 10337874 | 12/1998 |
| WO | WO9602393 | 2/1996 |
| WO | WO9635584 | 11/1996 |
| WO | WO9903681 | 1/1999 |
| WO | WO2000023279 | 4/2000 |

* cited by examiner

*Primary Examiner*—Juanita D Stephens

(57) ABSTRACT

A fluid delivery system includes a plurality of nozzles having an outer surface and a bore. A hydrophobic layer is applied to a portion of the outer surface of the nozzle and extends into the nozzle bore a determined distance.

2 Claims, 1 Drawing Sheet

HYDROPHOBIC NOZZLE EXIT WITH IMPROVED MICRO FLUID EJECTION DYNAMICS

BACKGROUND

Ink jet printers operate by ejecting tiny drops of ink from a printhead onto a printing medium, such as paper. The printhead normally includes a nozzle plate having a plurality of nozzles through which tiny ink droplets are ejected onto the paper to collectively create an image. To deliver ink to the nozzles, the printhead includes a plurality of ink firing chambers, each fluidically connected to an associated nozzle through a bore. Within each firing chamber is a heat-generating resistor that is selectively excited to heat the ink in the chamber, which creates a bubble. As the bubble expands, some of the ink is forced through the bore out of the nozzle onto the paper. A plurality of ink drops collectively form a desired image on the paper.

The quality of the resulting image depends in part on the trajectory of the ink drops as they are ejected from the printhead nozzles. Poor ink drop trajectory and velocity are sometimes caused by ink puddles that form at the nozzle exit. In some cases, ink puddles are the result of poor control over the ink drop as the ink enters the bore and is ejected from the nozzle. In other cases, ink puddles are the result of ink overshooting, ink drop breaks, and hydrophilic (water attracting) nozzle surfaces. Excessive ink puddling can not only distort the trajectory of the ink drop, but it can also cause intermittent nozzle shutdown preventing any ink from ejecting onto the paper therefrom.

Prior attempts to prevent ink from puddling at the nozzle exit include using ink formulations that incorporate additives to inhibit puddling. Unfortunately, such additives can negatively affect the ink and are not chemically compatible with all printing systems and can cause damage to some internal components of the printhead.

Another previously attempted solution includes applying a non-wetting, hydrophobic coating to the outer surface of the nozzle plate to inhibit the ink from adhering to the outer surface of the nozzle exit. However, providing a hydrophobic coating only to the exterior surface of the nozzle exit does not provide control over the position of the ink drop in the bore of the nozzle. As a result, excess ink remains in the bore after a drop has been ejected, causing additional puddling at the nozzle exit. The embodiments described hereinafter were developed in light of these and other drawbacks.

BRIEF DESCRIPTION OF THE DRAWINGS

The present embodiments will now be described, by way of example, with reference to the accompanying drawings, in which.

DETAILED DESCRIPTION

A system and method for controlling the position of an ink drop in a printhead nozzle are provided. By applying a hydrophobic coating to an outer surface of the nozzle and selectively extending the hydrophobic coating over the edge of the nozzle a determined distance into the bore, the position of the ink drop can be controlled to reduce or eliminate the amount of ink that puddles at the nozzle exit.

Figure 1:
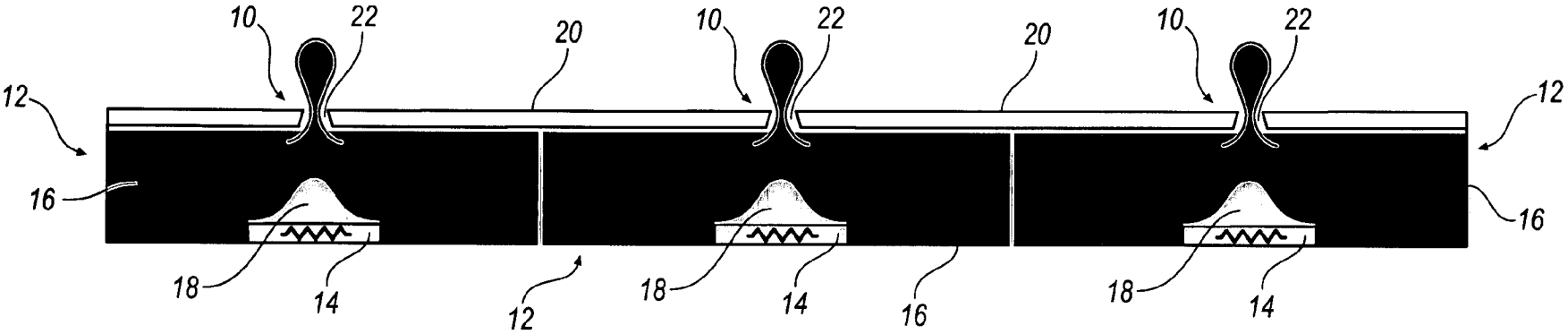
FIG. 1 is a general illustration of the formation of an ink drop in a printhead firing chamber.

A printhead typically includes, at a minimum, hundreds of nozzles with associated ink reservoirs (not shown) that deliver ink to firing chambers, which are subsequently activated to eject ink drops onto a printing medium. FIG. 1 illustrates three exemplary printhead nozzles 10 in a single printhead, each nozzle having an associated firing chamber 12, and an associated heat-generating resistor 14. When energized, the heat-generating resistor 14 vaporizes the ink 16 in the chamber 12 creating a bubble 18. The pressure of the expanding bubble 18 forces some of the ink 16 toward a nozzle plate 20 and through a nozzle bore 22 in the nozzle plate 20 onto a printing medium (not shown).

Figure 3B:
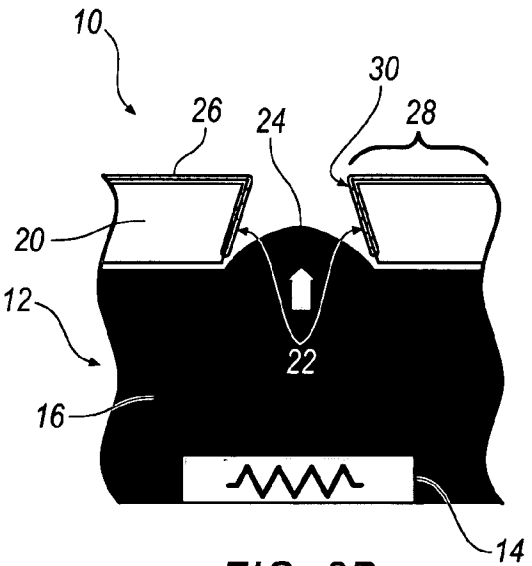
FIG. 3B illustrates a hydrophobic coating applied to the outer surface of the printhead nozzle and extending into a portion of the nozzle bore according to another embodiment.
Figure 3A:
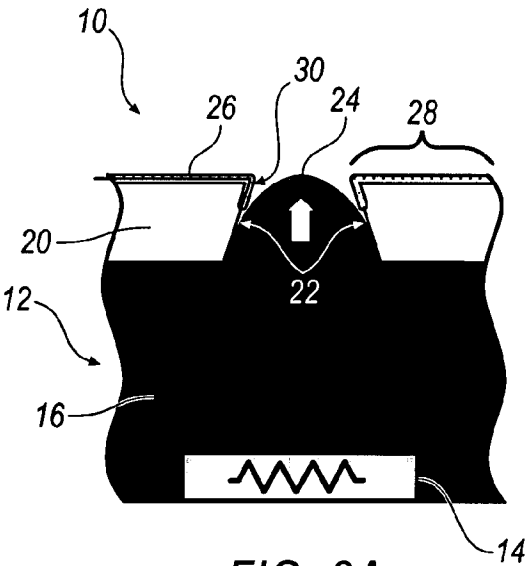
FIG. 3A illustrates a hydrophobic coating applied to the outer surface of the printhead nozzle and extending into a portion of the nozzle bore according to an embodiment.
Figure 2:
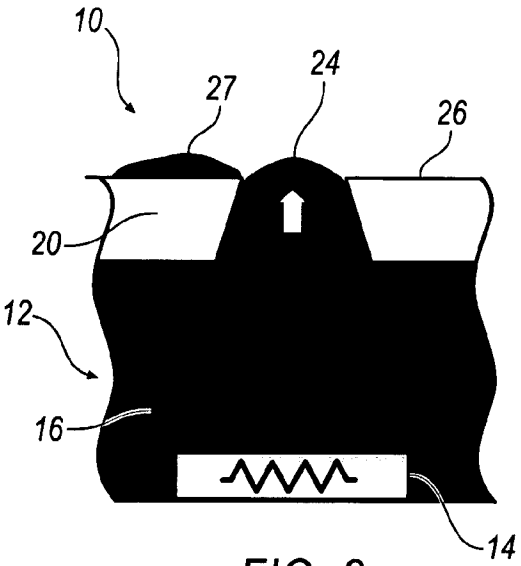
FIG. 2 (PRIOR ART)
FIG. 2 illustrates a hydrophobic coating applied to the outer surface of a printhead nozzle in a known manner.

FIGS. 2, 3A, and 3B illustrate an enlarged view of a printhead nozzle 10 having a hydrophobic coating applied to the outer surface of the nozzle and in varying extents to the nozzle bore 22 (FIGS. 3A and 3B). In each FIGS. (2, 3A, and 3B), as the ink 16 protrudes toward the nozzle bore 22 in the firing chamber 12, a curved upper surface, or meniscus 24, is formed on the leading surface of the ink. To prevent ink puddling, it is desirable to control the position of the ink meniscus 24 as the drops are ejected from the nozzle 10.

FIG. 2 illustrates a known nozzle configuration having a hydrophobic coating 26 on only the outer surface 28 of the nozzle 10. In this configuration, there is nothing to hold back or control the ink meniscus 24 in the bore 22. Consequently, ink may leak from the nozzle and puddle at the nozzle exit.

FIG. 3A, however, illustrates an exemplary embodiment wherein the hydrophobic coating 26 extends over the edge 30 of the outer surface 28 and into a portion of the bore 22. In this case, the ink meniscus 24 remains in the bore 22 up to the portion of the bore 22 having the hydrophobic coating 26. Similarly, FIG. 3B illustrates a nozzle 10 wherein the depth of the hydrophobic coating 26 is adjusted further into the bore 22. FIGS. 3A and 3B collectively illustrate the relationship between the extent of the hydrophobic coating 26 and the position of the ink meniscus 24 in the bore 22.

A hydrophobic coating in the nozzle bore reduces the surface energy in the bore which controls the meniscus of the ink as it is forced toward the nozzle bore and exit. The position, or extent, of the hydrophobic coating in the bore of the nozzle is variable and is determined by the desired performance criteria of the printer. As an example, the performance criteria can be based upon the particular type of printer, the type of printhead, the desired quality of the printed image, or in some cases, the type and color of ink used. By selectively determining the extent of the coating in the bore, the meniscus of the ink is controllable. In this way, the ink drop is prevented from leaking out of the nozzle bore and puddling around the exit. In some embodiments, all of the nozzle bores within a nozzle plate have a hydrophobic coating to the same extent within the bore. In other embodiments, the extent of the hydrophobic coating in each of the nozzle bores of a printer may vary from nozzle to nozzle, or printhead to printhead.

An exemplary method for applying and adjusting the position of the hydrophobic coating in the bore is carried out by vapor phase chemical deposition, using a differential pressurizing self-assembled monolayer (DP-SAM) process.

By adjusting the pressure difference between the interior and exterior portion of the bore 22, the extent of the hydrophobic coating in the bore can be controlled. In this way, the meniscus of the ink is controlled by the hydrophobic coating in the bore, reducing the puddling of ink at the nozzle exit. Other methods for applying and controlling the position of the hydrophobic coating in the nozzle may be employed.

While the present invention has been particularly shown and described with reference to the foregoing preferred embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and system within the scope of these claims and their equivalents be covered thereby. This description of the invention should be understood to include all novel and nonobvious combinations of elements described herein, and claims may be presented in this or a later application to any novel and nonobvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A method for controlling the meniscus of ink in an ink delivery system, comprising:

applying a hydrophobic coating to at least a portion of an outer surface of a nozzle and extending said hydrophobic coating into a bore of said nozzle; and adjusting the extent of said hydrophobic layer in said bore to control the position of the meniscus based upon a desired performance criteria;

wherein applying said hydrophobic coating comprises employing a chemical deposition using a differential pressurizing self assembled monolayer process.

2. A method according to claim 1, wherein said performance criteria is related to at least one of the following: type of printer, type of printhead, desired quality of the printed image, and color of ink used.

* * * * *